United States Patent [19]

Fildan

[11] 4,335,728

[45] Jun. 22, 1982

[54] FASTENER FOR MATERNITY-NURSING BRASSIERE

[76] Inventor: Gerhard Fildan, Dieselstr. 20, D-7250 Leonberg, Fed. Rep. of Germany

[21] Appl. No.: 182,137

[22] Filed: Aug. 28, 1980

[30] Foreign Application Priority Data

Oct. 18, 1979 [DE] Fed. Rep. of Germany ... 7929525[U]

[51] Int. Cl.[3] ..... A41C 3/04

[52] U.S. Cl. ..... 128/460

[58] Field of Search ..... 128/460, 438, 441, 450; 16/128; 24/230 R, 238, 201 R

[56] References Cited

U.S. PATENT DOCUMENTS 1,956,250 4/1934 Rosenthal ..... 128/460

3,439,685 4/1969 Defru ..... 128/460

*Primary Examiner*—Doris L. Troutman

*Attorney, Agent, or Firm*—Karl F. Ross

[57] ABSTRACT

A maternity-nursing brassiere has a frame supported by two shoulder straps linked therewith through a pair of connector plates of resilient plastic material each having an upper eye engaged by a loop of the respective shoulder strap and a lower eye engaged by a loop of a corresponding frame strap. Two cups on the frame have upper flaps terminating in a pair of tapes each looped through an eye of a respective latch plate which is insertable between two mounting lugs rising from the associated connector plate, these lugs being wedge-shaped to form a downwardly converging gap between them. A detent in the form of an L-shaped handle is hinged to the mounting lugs of the respective connector plate and has beveled flanks fitting between them in a closure position in which a tongue constituting the shorter leg of the "L" enters a groove in the connector plate with the handle lying nearly flat against that plate; the associated latch plate, which has another eye retained by the tongue in the closure position, can be released therefrom by rotating the handle about its hinge axis against the resistance of the elastic mounting lugs which restores the handle to its closure position after removal of the latch plate, the latter being upwardly reinsertable against the elastic restoring force with a snap fit and without reoperation of the handle.

2 Claims, 7 Drawing Figures

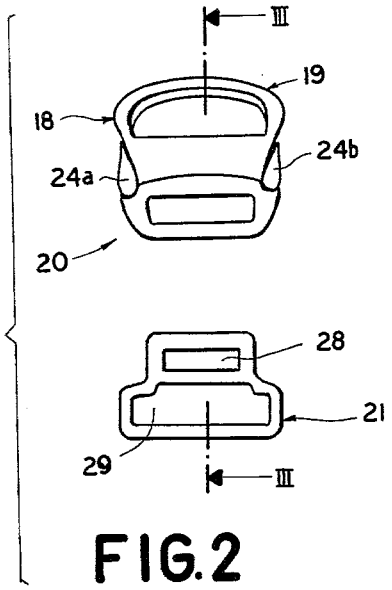
FIG. 2
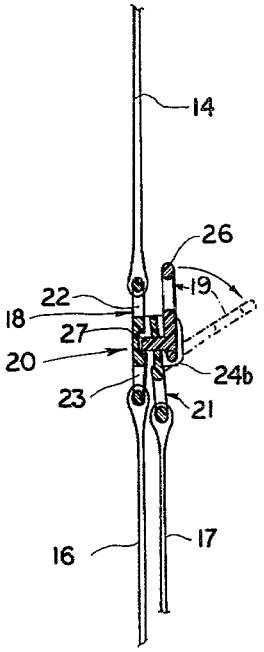
FIG. 3
FIG. 4
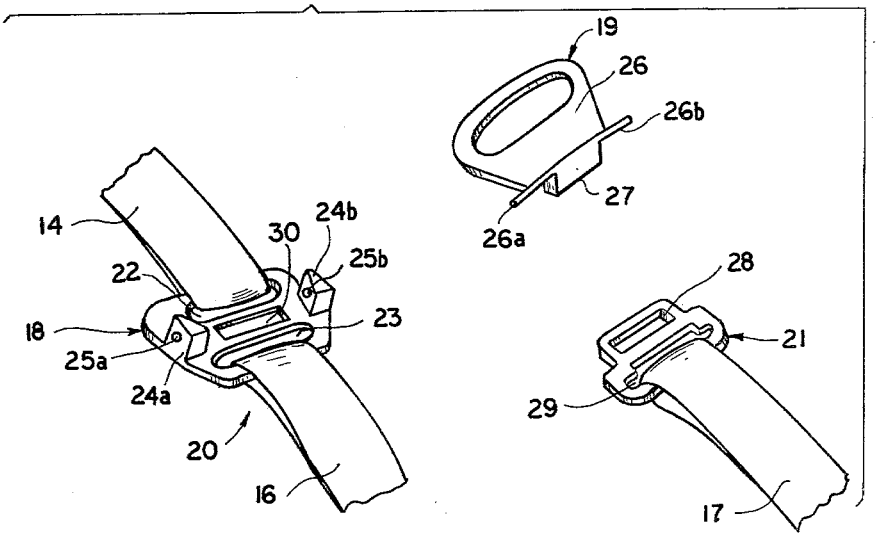

FASTENER FOR MATERNITY-NURSING BRASSIERE

FIELD OF THE INVENTION

My present invention relates to a brassiere of the maternity-nursing type whose cups are provided with flaps that can be individually opened to expose one or the other nipple of the wearer.

BACKGROUND OF THE INVENTION

In such a nursing bra it is generally convenient to arrange the openable flap in the upper flap of the cup and to provide it with a clasp allowing it to be releasably fastened to an associated connector which links an overlying part of the frame with a respective shoulder strap. Such clasps are already known in the art; reference may be made in this connection to U.S. Pat. Nos. 921,846 and 3,200,464, for example, as well as to my prior U.S. Pat. No. 4,000,544.

OBJECT OF THE INVENTION

The object of my present invention is to provide an improved fastener construction for a nursing bra of the aforedescribed type which is inexpensive to manufacture, secure in its operation and easy to manipulate.

SUMMARY OF THE INVENTION

I realize this object, in accordance with the present invention, by providing a connector plate of resilient (preferably plastic) material formed integral with a pair of laterally spaced-apart mounting lugs which rise from a generally vertical face of that plate and have confronting sides converging in a downward direction so as to define a downwardly narrowing gap between them into which a latch member attached to the flap of the respective cup is insertable from below. A detent member or lever hinged to the mounting lugs of the connector plate is swingable between a closure position and a release position, the converging sides of the lugs coacting with corresponding flanks of the detent member for elastically biasing same into its closure position.

The detent member, which like the latch member advantageously consists of the same preferably thermoplastic resilient material, may be generally L-shaped with a longer leg forming a handle and a shorter leg forming a tongue which is engageable with an eye of the latch member. The flanks coacting with the converging mounting-lug sides are then provided on the longer leg which substantially parallels the aforementioned face of the connector plate in its closure position and thus prevents a swing beyond that position which would disengage the latch member. An additional stop may be provided by an edge of a depression in the connector plate accommodating the shorter leg or tongue of the detent member in the closure position. After the release of the latch member, the latter may be reengaged with the tongue of the detent member by reinsertion from below into the gap between the mounting lugs, against their elastic restoring force, with a snap fit and without reoperation of the handle.

Pursuant to another advantageous feature of my invention, the mounting lugs have a wedge-shaped profile in a plane parallel to the front face of the connector plate whereby their restoring force intensifies during a forward and downward swing of the handle, through about 90°, into its release position.

BRIEF DESCRIPTION OF THE DRAWING

The above and other features of my invention will now be described in detail with reference to the accompanying drawing in which:

FIG. 2 is a face view of one of the fasteners of FIG. 1, shown disassembled and drawn to a somewhat larger scale;

FIG. 3 is a cross-sectional view of the fastener as seen on the line III—III of FIG. 2 but in assembled position and with tapes attached; and FIG. 4 is an exploded perspective view of the fastener shown in FIGS. 2 and 3.

SPECIFIC DESCRIPTION

Figure 1:
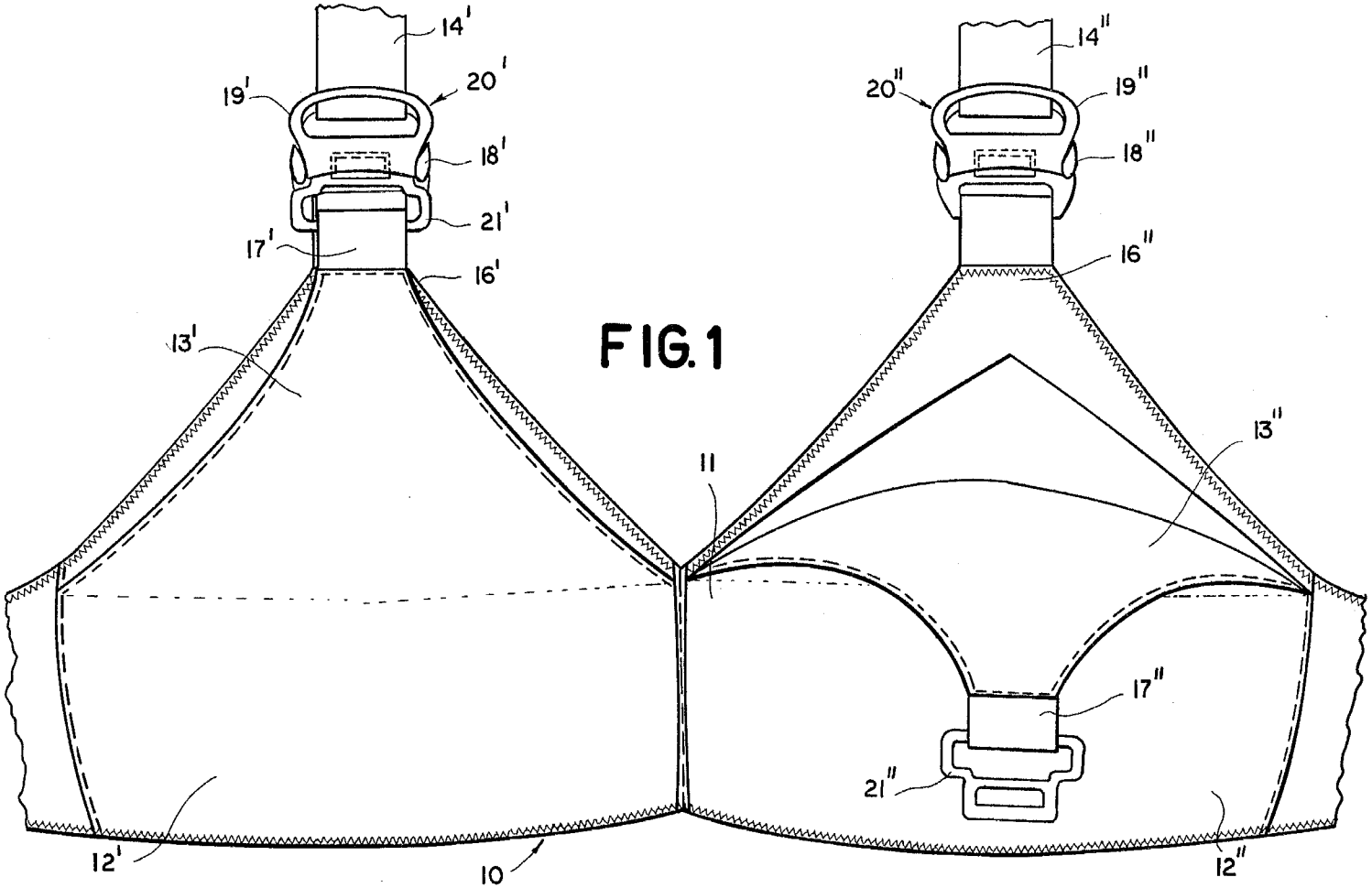
FIG. 1 is a front view of a nursing bra equipped with a pair of fasteners according to my invention.

In FIG. 1 I have shown an essentially conventional nursing bra 10 with a fabric frame 11, a pair of cups 12', 12'' having openable flaps 13' and 13'', a pair of shoulder straps 14' and 14'' (illustrated only in part), frame straps 15', 15'' extending above each cup, and tapes 17', 17'' secured to the tips of the flaps. The shoulder and frame straps are linked to each other by respective fasteners 20', 20'' including connector plates 18', 18'' which are provided with detent members 19', 19'' designed to engage respective latch members 21', 21'' attached to tapes 17' and 17''. In FIG. 1 the flap 13' is shown closed, with latch member 21' engaging connector plate 18', while flap 13'' is open, its latch member 21'' being disengaged.

I shall now describe, with reference to FIGS. 2–4, a fastener 20 representative of the two fasteners 20', 20'' shown in FIG. 1.

Fastener 20 has a connector plate 18 or elastomeric thermoplastic material provided with eyes 22, 23 which are traversed by loops of a shoulder strap 14 and a frame strap 16, respectively. Two mounting lugs **24*a*, 24*b* rise integrally from a front face of plate 18 and are provided with aligned bores 25*a*, 25*b* accommodating respective studs 26*a*, 26*b* of a detent member 19 which is thereby hinged to the connector plate for swinging between a closure position and a release position respectively illustrated in solid and phantom lines in FIG. 3. Detent member 19 is L-shaped with a longer leg 26 forming a handle and a shorter leg 27 forming a tongue, the latter being engageable with an eye 28 of a flat latch member 21 to which a tape 17 is attached via an eye 29. Upon insertion of member 21 into the gap between lugs 24*a* and 24*b*, with detent member 19 in its closure position, the latter is displaced by the thrust against an elastic restoring force exerted by the wedge-shaped lugs 24*a*, 24*b* upon the downwardly converging flanks of member 21 adjacent thereto. Overcoming the resistance of lugs, member 19 swings sufficiently far in a clockwise direction (FIG. 3) to let the front edge of member 21 clear its tongue 27 until the latter snaps into eye 28 and retains the latch member in position. When the wearer wants to open the flap attached to the corresponding tape 17, she swings the handle 26 in the same clockwise direction through an arc of about 90° or more whereupon the latch member 21** can be readily withdrawn; the detent member then returns to its full-line closure position under the aforementioned restoring force.

Plate 18 is shown to have a rectangular depression or recess 30 (which could also be a throughgoing slot) which accommodates the tongue 27 of member 19 in the closure position.

As will be apparent from FIG. 2, the flanks of detent member or lever 19 fit closely between the wedge-shaped mounting lugs 24*a*, 24*b* of plate 18 in the closure position, contacting their confronting sides along downwardly converging surfaces. Since these lugs project beyond the outer surface of handle 26 in this position, they are progressively spread apart by the outwardly swung handle so as to give rise to the elastic restoring force tending to return the handle to its position proximal to plate 18 whose inherent elasticity eliminates the need for any separate restoring spring. If desired, eyes 22, 23 could be formed on the same side of mounting lugs 24*a*, 24*b* rather than on opposite sides as shown.

I claim:

1. In a maternity-nursing brassiere having a frame with a pair of cups and supporting means including a pair of shoulder straps linked with said frame via respective fasteners for securing said frame to the body of a wearer, each of said cups having a flap normally attached to one of said fasteners and releasable therefrom to expose the wearer's underlying nipple, the improvement wherein each of said fasteners comprises:

a connector plate of resilient material formed integral with a pair of laterally spaced-apart mounting lugs rising from a generally vertical face thereof and defining a downwardly narrowing gap between them.

a latch member attached to the flap of the respective cup and insertable from below into said gap; and a detent member on said connector plate hinged to said mounting lugs for swinging between a closure position and a release position, said mounting lugs having confronting sides which coact with corresponding flanks of said detent member for elastically biasing same into said closure position, said confronting sides and said flanks contacting each other in said closure position along downwardly converging areas.

2. The improvement defined in claim 1 wherein said detent member is generally L-shaped with a longer leg forming a handle and a shorter leg forming a tongue engageable with an eye on said latch member, said detent member being swingable about an axis located near the junction of said legs.

* * * * *